US005763378A

United States Patent [19]

Painter et al.

[11] Patent Number: 5,763,378

[45] Date of Patent: Jun. 9, 1998

[54] PREPARATION OF COMPOSITE PARTICULATES CONTAINING DIACYL PEROXIDE FOR USE IN DISHWASHING DETERGENT COMPOSITIONS

[75] Inventors: Jeffrey D. Painter, Loveland, Ohio; Bruce N. Wagner, Florence, Ky.; Melissa D. Aquino, Cincinnati, Ohio

[73] Assignee: The Procter & Gamble Company, Cincinnati, Ohio

[21] Appl. No.: 627,821

[22] Filed: Apr. 2, 1996

Related U.S. Application Data

[63] Continuation-in-part of Ser. No. 424,132, Apr. 17, 1995, abandoned.

[51] Int. Cl.[6] ..... C11D 3/395

[52] U.S. Cl. ..... 510/224; 510/220; 510/226; 510/230

[58] Field of Search ..... 134/25.2; 264/117; 510/224, 226, 230, 375, 378, 379, 445, 475, 511, 220

[56] References Cited

U.S. PATENT DOCUMENTS

| | | | |
|---|---|---|---|
| 2,955,905 | 10/1960 | Davies et al. | 8/111 |
| 3,324,040 | 6/1967 | Spoor | 252/186 |
| 3,606,990 | 9/1971 | Gobert et al. | 8/111 |
| 3,634,266 | 1/1972 | Theile et al. | 252/132 |
| 4,021,360 | 5/1977 | McLaughlin et al. | 252/99 |
| 4,025,453 | 5/1977 | Kravetz et al. | 252/102 |
| 4,033,894 | 7/1977 | McLaughlin et al. | 252/99 |
| 4,086,175 | 4/1978 | Kravetz et al. | 252/99 |
| 4,086,177 | 4/1978 | Kubitschek et al. | 252/102 |
| 4,092,258 | 5/1978 | McLaughlin et al. | 252/99 |
| 4,100,095 | 7/1978 | Hutchins et al. | 252/99 |
| 4,154,695 | 5/1979 | McCrudden et al. | 252/99 |
| 4,387,044 | 6/1983 | Sanchez et al. | 252/426 |
| 4,444,674 | 4/1984 | Gray | 252/95 |
| 4,515,929 | 5/1985 | Tang | 526/228 |
| 4,530,766 | 7/1985 | Hann et al. | 210/701 |
| 4,547,305 | 10/1985 | Cornelissen et al. | 252/94 |
| 4,568,476 | 2/1986 | Kielman et al. | 252/95 |
| 4,652,392 | 3/1987 | Baginski et al. | 252/109 |
| 4,655,953 | 4/1987 | Oakes | 252/99 |
| 4,720,353 | 1/1988 | Bell | 252/309 |
| 4,983,315 | 1/1991 | Glogowski et al. | 252/102 |
| 4,988,363 | 1/1991 | Barnes | 8/111 |
| 5,066,425 | 11/1991 | Ofosu-Asante et al. | 252/546 |
| 5,089,162 | 2/1992 | Rapisarda et al. | 252/102 |
| 5,130,044 | 7/1992 | Mitchell et al. | 252/102 |
| 5,130,045 | 7/1992 | Mitchell et al. | 252/102 |
| 5,173,207 | 12/1992 | Drapier et al. | 252/99 |
| 5,213,706 | 5/1993 | Rapisarda et al. | 252/135 |
| 5,246,612 | 9/1993 | Van Dijk et al. | 252/102 |
| 5,258,132 | 11/1993 | Kamel et al. | 252/94 |
| 5,314,639 | 5/1994 | Torenbeek | 252/186.23 |
| 5,460,743 | 10/1995 | Delwel et al. | 252/174.23 |
| 5,710,115 | 1/1998 | Patel et al. | 510/224 |

FOREIGN PATENT DOCUMENTS

| | | |
|---|---|---|
| 0 239 379 A2 | 9/1987 | European Pat. Off. . |
| 0 295 093 A1 | 12/1988 | European Pat. Off. . |
| 0 337 535 A2 | 10/1989 | European Pat. Off. . |
| 0 504 091 A1 | 9/1992 | European Pat. Off. . |
| 0 516 553 A2 | 12/1992 | European Pat. Off. . |
| 0619366 A1 | 10/1994 | European Pat. Off. . |
| 0684304 A2 | 11/1995 | European Pat. Off. . |
| 1 293 063 | 10/1972 | United Kingdom . |
| 95/33817 | 12/1995 | WIPO . |
| 96/17921 | 6/1996 | WIPO . |

OTHER PUBLICATIONS

"Peroxides and Peroxy Compounds, Organic" published in the *Encyclopedia of Chemical Technology*, Third Edition, vol. 17, 1982, pp. 27–28 and 63–72.

"The Stability of a Benzoyl Peroxide Acne Cream Product" published in the *Canadian Journal of Pharmaceutical Sciences*, Dec. 1967, pp. 101–102.

*Primary Examiner*—Michael Lusignan

*Attorney, Agent, or Firm*—Pankaj M. Khosla; Ken K. Patel; Kim W. Zerby

[57] ABSTRACT

There is provided a process for ma ing composite particulates comprising from about 1% to about 50% by weight of discrete particles of water-insoluble diacyl peroxide having a mean particle size of less than about 300 microns and from about 30% to about 99% by weight of a carrier material which melts in the range of from about 38° C. to about 77° C. This preparation process involves the steps of (i) mixing the particles of water-insoluble diacyl peroxide into the carrier material while the carrier material is in a molten state and then (ii) rapidly cooling and solidifying the resultant mixture and thereafter (iii) wor ing the solidified mixture if or as necessary to form the composite particulates therefrom. Detergent compositions containing the composite particulates are also provided.

24 Claims, No Drawings

PREPARATION OF COMPOSITE PARTICULATES CONTAINING DIACYL PEROXIDE FOR USE IN DISHWASHING DETERGENT COMPOSITIONS

This is a continuation-in-part of application Ser. No. 08/424,132, filed on Apr. 17, 1995, now abandoned.

TECHNICAL FIELD

The present invention relates to the preparation of composite particulates which contain the peroxygen bleaching agent, diacyl peroxide. These composite particulates are particularly useful components of automatic dishwashing detergent compositions.

BACKGROUND OF THE INVENTION

Automatic dishwashing detergents (hereinafter ADD compositions or products) used for washing tableware (i.e. glassware, china, silverware, pots and pans, plastic, etc.), in the home or institutionally, in machines especially designed for this purpose have long been known. Dishwashing in the seventies, for example, is reviewed by Mizuno in Vol. 5, Part III of the Surfactant Science Series, Ed. W. G. Cutler and R. C. Davis, Marcel Dekker, N.Y., 1973, incorporated by reference. The unique requirements for cleaning tableware and leaving it in a sanitary, essentially spotless, residue-free state have indeed resulted in so many specially formulated ADD compositions that the body of art pertaining thereto is now recognized as being quite distinct from other cleaning product art.

ADD products will generally contain such detergent composition components as surfactants, builders, alkalinity sources and enzymes. ADD products can also usefully contain bleaching agents since both chlorine and peroxygen bleaches can be effective for stain and/or soil removal in the automatic dishwashing context. Chlorine bleaches, while effective cleaners, are often not compatible with other detergent ingredients and/or require additional processing. Peroxygen bleaches, on the other hand, are less reactive, but the performance provided by such peroxygen bleaches can be both temperature and/or pH dependent. As a consequence, there has been a substantial amount of research directed toward developing bleaching systems which contain an activator that renders peroxygen bleaches effective under various wash liquor conditions. Also the conventional chlorine bleaches and the conventional peroxygen bleaches, i.e., perborate and percarbonate, have not been found to be particularly effective at removing stains from plasticware.

Another type of peroxygen bleaching agent comprises the diacyl peroxides (DAPs). In the laundry field, certain diacyl peroxides have been found to be effective for the removal of tea stains from fibrous material. It has also been found that DAPs can provide useful stain removal performance in the automatic dishwashing context. In particular, water-insoluble forms of DAP are especially useful in removing a wide variety of stains, including tea stain, fruit juice and carotenoid stains, from plasticware. Further, it has been surprisingly found that the water-insoluble diacyl peroxides do not adversely react with chlorine bleach. Thus, diacyl peroxides can provide an additional dimension of stain removal not obtained with chlorine bleach is alone.

It has been found, however, that when conventionally-sized large (typically 400–700 microns) diacyl peroxide particles are employed in machine dishwashing products and methods, a problem can occur with the formation of residues (observed as insoluble diacyl peroxide particles) on the dishware articles being washed. Diacyl peroxide in such large particle size forms are generally those resulting from conventional processes in which diacyl peroxide is produced as a raw material. Large particle diacyl peroxide may also be prepared by agglomerating diacyl peroxide with stabilizing agents. Possible agglomeration processes include those relying on wet agglomeration or pressure agglomeration (compaction), to prepare such relatively large particles. To stabilize diacyl peroxide agglomerates, agglomeration step (s) may be followed by a coating or encapsulation step (to provide a protective layer).

The residue problem associated with the use of conventionally-sized particles of diacyl peroxide as hereinbefore discussed can be effectively overcome when diacyl peroxide is provided to a dishwashing solution in the form of small particles, in particular, particles having a mean particle size of less than 300 microns, preferably less than 200 microns. The delivery of small particle size (<300 microns) diacyl peroxide particles into the wash also provides improved stain removal performance compared with that obtained when larger particles of diacyl peroxide are delivered to the wash solution.

However, the direct incorporation of such small diacyl peroxide particles into a particulate detergent composition can present other problems. Such granular compositions typically should be made up of particles having mean particle sizes which are all similar to each other, to avoid segregation of components in the composition. Such compositions often comprise particles having mean particles sizes in a defined range of from about 400 to about 2400 microns, more usually from about 500 to about 2000 microns, to achieve good flow and absence of dustiness properties. Any fine or oversize particles outside of these limits must generally be removed by sieving to avoid a particle segregation problem. Addition of fine particle diacyl peroxide into conventional granular dishwashing detergent products thus potentially presents a component separation problem. Fine diacyl peroxide particles in a detergent composition matrix may also have chemical stability problems caused by a tendency of the fine particles to interact with other detergent composition components.

In light of all this, the formulator may very well wish to incorporate small diacyl peroxide particles, preferred for stain removal performance and residue avoidance reasons, into a detergent matrix containing other components having a generally larger overall mean particle size distribution. In so doing, however, the formulator must avoid the component segregation and chemical stability problems associated with the use of small diacyl peroxide particles in this context.

Given the foregoing considerations, it is an object of the present invention to provide diacyl peroxide-containing composite particulates which are useful for incorporating diacyl peroxide into automatic dishwashing detergent products in a form which maximizes its stain removal performance and chemical stability but which minimizes its particle segregation and residue-forming problems. It is a further object of the present invention to incorporate such diacyl peroxide-containing composite particulates in the form of flakes, pastilles or extrudates which, while having a size distribution comparable to that of the other components of the dishwashing detergent composition, allow delivery of diacyl peroxide particles into the dishwashing solution at a particle size at least as small as the diacyl peroxide particles originally used to prepare the composite particulates. Such objectives can be realized by preparing and using diacyl peroxide-containing composite particulates in accordance with the process of the instant invention.

SUMMARY OF THE INVENTION

The process of the present invention involves the preparation of diacyl peroxide-containing composite particulates especially suitable for incorporation into granular automatic dishwashing detergent products. Such a process comprises the steps of A) providing a plurality of particles comprising water-insoluble diacyl peroxide and having a mean particle size less than about 300 microns;

B) combining the diacyl peroxide particles of Step A) with a molten carrier material which melts within the range of from about 38° C. to 77° C., while agitating the resulting particle-carrier combination to form a substantially uniform admixture of the particles and the carrier material;

C) rapidly cooling the particle-carrier admixture of Step B) to form a solidified admixture of particles and carrier material; and D) further working the solidified particle-carrier material admixture formed in Step C) if or as necessary to form the desired composite particulates.

Such composite particulates comprise from about 1% to 50% by weight of the diacyl peroxide particles and from about 30% to 99% by weight of the carrier material. These composite particulates have a mean particulate size of from about 200 to 2,400 microns and preferably have a free water content of less than about 10% by weight.

The present invention also relates to the diacyl peroxide-containing composite particulates as prepared by the process herein and to detergent compositions, especially automatic dishwashing detergent products, which utilize these diacyl peroxide-containing composite particulates.

The composite particulates of this invention comprise both discrete water-insoluble diacyl peroxide particles of relatively small particle size and a carrier material, with the composite particulates having a mean particulate size which is comparable to that of the other conventional component particulates used in dishwashing detergent compositions. Such particulates thus allow for delivery to a wash solution of small water-insoluble particles of diacyl peroxide, as are desired for performance reasons, when the carrier material in the composite particulates dissolves away in the aqueous wash solution, thereby releasing the diacyl peroxide particles.

While other particulate forms are possible, the composite particulates of this invention are preferably in the form of flakes or pastilles. Surprisingly, it has been found that the particulates, particularly when formed as flakes or pastilles, provide superior stain removal from plastic when compared to the diacyl peroxide raw material itself. The particulates (e.g. flakes and pastilles) have also been found to exhibit enhanced storage stability in the presence of a detergent matrix, again as compared to the diacyl peroxide raw material itself. Further, the composite particles do not segregate from other particles in the granular detergent compositions into which they are incorporated. Finally, compositions containing such composite particulates do not leave diacyl peroxide residue on dishware washed using such compositions.

DETAILED DESCRIPTION OF THE INVENTION

The composite particulates prepared in accordance with the present invention comprise discrete particles of water-insoluble diacyl peroxide and a carrier material, and optionally other components, particularly stabilizing additives. Each of these materials, the steps in the composite particulate preparation process, the composite particulates so prepared and automatic dishwashing detergents containing these composite particulates are described in detail as follows:

Diacyl Peroxide Bleaching Species

The composite particulates in accordance with the present invention comprise from about 1% to about 50% by weight, more preferably from about 5% to about 40% by weight, most preferably from about 10% to about 35% by weight of the composite of discrete particles of water-insoluble diacyl peroxide. These particles have a mean particle size of less than about 300 microns, preferably less than about 200 microns, more preferably from about 1 to about 150 microns, most preferably from about 10 to about 100 microns.

The diacyl peroxide is preferably a water-insoluble diacyl peroxide of the general formula:

$$RC(O)OO(O)CR^1$$

wherein R and $R^1$ can be the same or different, and each comprises a hydrocarbyl group containing more than ten carbon atoms. Preferably, at least one of these groups has an aromatic nucleus.

Examples of suitable diacyl peroxides are those selected from the group consisting of dibenzoyl peroxide, benzoyl glutaryl peroxide, benzoyl succinyl peroxide, di-(2-methybenzoyl) peroxide, diphthaloyl peroxide and mixtures thereof, more preferably dibenzoyl peroxide, diphthaloyl peroxides and mixtures thereof. The preferred diacyl peroxide is dibenzoyl peroxide.

The diacyl peroxide thermally decomposes under wash conditions (i.e. typically from about 38° C. to about 71° C.) to form free radicals. This occurs even when the diacyl peroxide particles are water-insoluble.

Surprisingly, particle size can play an important role in the performance of the diacyl peroxide, not only in preventing residue deposit problems, but also in enhancing the removal of stains, particularly from stained plasticware. The mean particle size of the diacyl peroxide particles produced in wash solution after dissolution of the particulate composite carrier material, as measured by a laser particle size analyzer (e.g. Malvern) on an agitated mixture with water of the diacyl peroxide, is less than about 300 microns, preferably less than about 200 microns. Although water insolubility is an essential characteristic of the diacyl peroxide used in the present invention, the size of the particles containing it is also important for controlling residue formation in the wash and maximizing stain removal performance.

Carrier Material

The composite particulates comprise from about 30% to about 99% by weight, more preferably from about 40% to about 95% by weight, most preferably from about 50% to about 90% by weight of the composite of a carrier material. The carrier material melts in the range from about 38° C. (100° F.) to about 97° C. (170° F.), preferably from about 43° C. (1 10° F.) to about 71° C. (160° F.), most preferably from about 46° C. (115° F.) to 66° C. (150° F.).

The carrier material should be inert to reaction with the diacyl peroxide component of the particulate under processing conditions and after solidification. Furthermore, the carrier material is preferably water-soluble. Additionally, the carrier material should preferably be substantially free of moisture present as unbound water.

Polyethylene glycols, particularly those of molecular weight of from about 2000 to about 12000, more particularly from about 4000 to about 10000 and most preferably about 8000 (PEG 8000), have been found to be especially suitable water-soluble carrier materials herein. Such polyethylene glycols provide the advantages that, when present in the wash solution, they exhibit soil dispersancy properties and show little or no tendency to deposit as spots or films on the articles in the wash.

Also suitable as carrier materials are paraffin waxes which should melt in the range of from about 38° C. (100° F.) to about 43° C. (110° F.), and $C_{16}$–$C_{20}$ fatty acids and ethoxylated $C_{16}$–$C_{20}$ alcohols. Carriers comprising mixtures of suitable carrier materials are also envisaged.

Stabilizing Additive

In a preferred embodiment, the composite particulates of the present invention will also contain a stabilizing additive which inhibits thermal decomposition of the diacyl peroxide and improves the stability of the composite particulates in the detergent product over time. Stabilizing additives are preferably selected from the group consisting of inorganic salts, antioxidants, chelants, and mixtures thereof. The stabilizing additive should not dissolve the diacyl peroxide. When present, the stabilizing additive in the particulate comprises by weight of the particulate from about 0.1% to about 30%, preferably from about 0.5% to about 25%, more preferably from about 1% to about 20%, most preferably from about 2% to 15%.

Preferably, the stabilizing additive is not miscible with other components of the particulate composition at temperatures at or below 38° C. (100° F.), preferably 49° C. (120° F.). In a particularly preferred embodiment the stabilizing agent would be soluble in the wash solution.

The inorganic salts useful as stabilizing additives include but are not limited to alkali metal sulfates, citric acid, and boric acid, and their salts, alkali metal phosphates, carbonates, bicarbonates and silicates and mixtures thereof. The alkali metal sulfates, phosphates, and citrates are preferred. Especially preferred inorganic salts are sodium sulfate, magnesium sulfate, sodium tripolyphosphate and sodium citrate, which, because they are non-alkaline, or only weakly alkaline, prevent alkaline hydrolysis in product.

Transition metal chelants which can be employed as the stabilizing additive are selected from the group consisting of polyacetate and polycarboxylate builders such as the sodium, potassium, lithium, ammonium and substituted ammonium salts of ethylenediamine tetraacetic acid, ethylenediamine disuccinic acid (especially the S,S-form), nitrilotriacetic acid, tartrate monosuccinic acid, tartrate disuccinic acid, oxydisuccinic acid, carboxymethyloxysuccinic acid, mellitic acid, sodium benzene polycarboxylate salts; nitrilotris(methylenephosphonic acid) diethylenetrinitrilopentakis(methylenephosphonic acid), 1-hydroxyethylidene-1,1-diphosphonic acid, other phosphonate chelants (e.g. Dequest line of products from Monsanto), ethylene-N,N'-bis(o-hydroxyphenylglycine), dipicolinic acid and mixtures thereof.

Antioxidants (radical trap, radical scavenger or free radical inhibitor) can also be suitable stabilizing additives. These compounds slow down or stop a reaction even though present in small amounts. It is believed the antioxidant would trap or scavenge the radical formed due to thermal decomposition of the peroxide bond. This would prevent the radical from further reacting or propagating the formation of another radical (self-accelerated decomposition). Since this material would be used in small amounts in the particle, it most likely would not hurt overall performance of the detergent composition. Suitable antioxidants include but are not limited to citric acid, phosphoric acid, BHT, BHA, α-tocopherol, Irganox series C (Ciba Giegy), Tenox series (Kodax) and mixtures thereof.

As stated, many of the above listed stabilizing additives can also provide other benefits in the detergent composition product (i.e. pH control, carbonate/silicate dispersion) as well as serve as the stabilizing additive. These ingredients therefore may also be added to detergent compositions in accordance with the present invention separately from the diacyl peroxide-containing composite particulates. Most preferably, however, such stabilizing agents will be combined with the diacyl peroxide particles prior to the combination of the diacyl peroxide particles with the carrier material.

Particulate Water Content

The composite particulates should have a low free water content to favor in-product stability and minimize the stickiness of the composite particulates. The composite particulates should thus preferably have a free water content of less than about 10%, preferably less than about 6%, more preferably less than about 3%, and most preferably less than 1%. Such low free water contents can be realized by centrifuging and/or drying the diacyl peroxide particles prior to their addition to the carrier material. Alternatively, but less preferably, any free water present in the diacyl peroxide particles can be chemically bound as water of hydration to a hydratable salt added to the discrete particles. The hydratable salt must be thermodynamically stable at expected product storage conditions. Magnesium sulfate and sodium tripolyphosphate are examples of suitable hydratable salts, with sodium tripolyphosphate being most preferred. Most preferably, water is removed by vacuum drying from the molten particle/carrier mixture before the mixture is solidified.

Composite Particulate Preparation Process

The composite particulates are made by a process comprising the following basic steps:

(i) providing a plurality of particles comprising water-insoluble diacyl peroxide as hereinbefore described;

(ii) combining these particles of water-insoluble diacyl peroxide with the carrier material as hereinbefore described, while the carrier material is in a molten state and while agitating this combination to form a substantially uniform admixture;

(iii) rapidly cooling the resultant admixture in order to solidify it; and thereafter (iv) further working the resulting solidified admixture, if necessary, to form the desired composite particulates.

(i) Combining/Mixing Step

The purpose of the combining/mixing step is to ensure dispersion of the discrete diacyl peroxide particles in the molten carrier material. In more detail, the combining/mixing step can be carried out using any suitable liquid/solid mixing equipment such as that described in Perry's Chemical Engineer's Handbook under 'Phase Contacting and Liquid/Solid Processing'. For example, the combining and subsequent mixing can be done in batch mode, using a simple agitated batch tank containing the molten carrier. The discrete diacyl peroxide particles can be added to the molten carrier and dispersed with an impeller. This is preferable for small batches which can be solidified quickly (for reasons hereinafter set forth).

Alternatively, and preferably, the combining/mixing can be done continuously to keep the contact time between the molten carrier and the diacyl peroxide very short. For example, a feeder (preferably a low friction vibratory feeder) can be used to meter the diacyl peroxide into the flowing molten carrier (e.g., through a powder eductor). The mixture can optionally be further dispersed using any suitable continuous liquid/solid mixing device such as an in-line mixer (such as those described in Chapter 19 of James Y. Oldshue, Fluid Mixing Technology, McGraw Hill Publishing Co., 1983) or a static or motionless mixer (e.g. from Kenics Corporation) in which stationary elements successively divide and recombine portions of the fluid stream. The shear rate can be varied both to optimize dispersion and to determine the eventual diacyl peroxide particle size that is obtained. In some applications, further diacyl peroxide particle size reduction can be accomplished through use of a colloid mill as the continuous liquid/solid mixing device. (This is not always tolerable by the diacyl peroxide because of heat buildup and increased rate of activity degradation in some carriers).

In a preferred embodiment the combining/mixing step acts such as to break up any aggregates which may have formed in the bulk of the diacyl peroxide. It is acceptable, and indeed can be preferred, that the mixing step leads to a slight reduction in the overall mean particle size of the diacyl peroxide particles.

In another preferred embodiment, the combining/mixing step takes place over a non-extended time interval to prevent any low level degradation of the diacyl peroxide in the presence of the molten carrier material at elevated temperatures. In particular, a time interval of less than 10 minutes, preferably less than 5 minutes, most preferably less than 2 minutes is employed for the combining/mixing step, that is the time interval from first contact of the components of the mixture until commencement of the cooling/solidification step. The combining/mixing step is preferably a continuous 'in-line' mixing step, preferably in which the shear rate is sufficient to achieve dispersion but contact time is kept to a minimum before the cooling/solidification step.

Alternatively, it is possible to provide the plurality of discrete diacyl peroxide particles in the form of an aqueous slurry or paste. Such an aqueous slurry or paste contains up to about 65% by weight of the discrete diacyl peroxide particles. More preferably, the paste or slurry will contain from about 30% to 50% by weight of the diacyl peroxide particles, mostly preferably from about 40% to 50% by weight of the particles. Slurries or pastes of this diacyl peroxide content are easily pumpable. Combining such a slurry or paste with the molten carrier material is also simpler than combining dry particles with the molten carrier.

If a slurry or paste comprising diacyl peroxide particles is combined with the molten carrier material, then the particle-carrier admixture which results should have water removed therefrom prior to the cooling and solidification steps. As hereinafter described in the "Optional Steps" section, water can be removed by any conventional means such as by thin film vacuum drying. Generally at least 95% of the water content of the particle-carrier admixture will be removed prior to cooling and solidification. Preferably substantially all of the water will be removed prior to cooling/solidification.

(ii) Cooling/Solidification and Particulate-Forming Steps

The combining/mixing step is followed by one or more subsequent steps involving rapidly cooling and thereby solidifying the mixture resulting from the combining/mixing step. Subsequent steps may also involve forming the composite particulates therefrom. These steps encompass executions wherein the solidification and particulate-forming aspects occur coincidentally, or alternatively where these steps are carried out sequentially in either order of occurrence.

In executions where solidification of the bulk mixture occurs, the particulate is formed from the solidified mixture by use of any suitable comminution procedure, such as grinding procedures.

Cooling and solidification can be carried out using any conventional equipment such as that described in Perry's Chemical Engineer's Handbook under 'Heat Exchangers for Solids'.

In a preferred embodiment, which involves the making of flake-form composite particulates, the solidification occurs by introducing the mixture onto a chill roll or cooling belt thus forming a layer of solid material on the roll or belt. This is followed by a step which comprises removing the layer of solid material from the roll or belt and thereafter comminuting of the removed solid material. This can be achieved, for example, by cutting the solid layer into smaller pieces, followed by reducing these pieces to an acceptable size using conventional size reduction equipment (e.g. Quadro Co-mil). The comminuted solidified material can be further worked as necessary by sieving the comminuted material to provide particulates of the desired mean particulate size and size distribution.

In another preferred embodiment which involves making pastille-form composite particulates, the cooling, solidification and particulate-forming aspects occur in an integral process involving the delivery of drops of the DAP-particle/carrier material mixture through a feed orifice onto a cooling belt. The feed orifice is preferably chosen so as to favor formation of pastilles having a mean particle size of from about 200 to about 2400 microns, more preferably from about 500 to about 2000 microns, and most preferably from about 600 to about 1400 microns. In such a process, further working of the solidified admixture is not necessary to achieve composite particulates of the desired size.

In still another preferred embodiment which involves making extruded composite particulates, particulate formation takes place in an extrusion process in which the DAP-particle/carrier material mixture is extruded through a die plate into a cooling drum. The die plate orifices are preferably chosen so as to favor formation of extrudates having a mean particle size of from about 200 to about 2,400 microns, more preferably from about 500 to about 2,000 microns, and most preferably from about 600 to about 1,400 microns. The solidified extrudates are then sieved to obtain composite particulates of the desired size fraction.

(iii) Optional Additional Steps

A preferred additional step comprises removing water from the molten diacyl peroxide/carrier admixture or from the composite particulates after their formation. This can be achieved by any of the methods commonly known in the art, most preferably through vacuum drying of the molten mixture before solidification (e.g. using a LUWA thin film dryer).

Another preferred additional step, particularly when flake or extrudate formation is involved, comprises the step of sieving the particulates to obtain composite particulates having a mean particle size of from about 200 to about 2400 microns, preferably from about 500 to about 2000 microns, most preferably from about 600 to about 1400 microns. Any oversize particulates can be subjected to a size reduction step and any undersized particulates can be reintroduced into the molten mixture of the combining/mixing step.

Detergent compositions

The composite particulates herein are useful components of detergent compositions, particularly those designed for use in automatic dishwashing methods.

The detergent compositions may additionally contain any known detergent components, particularly those selected from pH-adjusting and detergency builder components, other bleaches, bleach activators, bleach catalysts, silicates, dispersant polymers, low-foaming nonionic surfactants, anionic co-surfactants, enzymes, enzyme stabilizers, suds suppressors, corrosion inhibitors, fillers, hydrotropes and perfumes.

A preferred granular or powdered detergent composition comprises by weight:

(a) from about 1% to about 15% of the composite particulates as hereinbefore described;

(b) an additional bleach component comprising either
  (i) from about 0.01% to about 8% as available oxygen of a non-diacyl peroxide peroxygen bleach; or
  (ii) from about 0.01% to about 8% as available chlorine of chlorine bleach;

(c) from about 0.1% to about 60% of a pH adjusting component consisting of water-soluble salt or salt/builder mixture selected from sodium carbonate, sodium sesquicarbonate, sodium citrate, citric acid, sodium bicarbonate, sodium hydroxide, and mixtures thereof, (d) from about 3% to about 10% silicate as $SiO_2$;

(e) from 0 to about 10% of a low-foaming nonionic surfactant other than amine oxide;

(f) from 0 to about 10% of a suds suppressor;

(g) from 0% to about 5% of an active detersive enzyme; and (h) from 0% to about 25% of a dispersant polymer.

Such a composition provides a wash solution pH from about 9.5 to about 11.5.

pH-Adjusting Control/Detergency Builder Components

The detergent compositions herein will preferably provide wash solutions having a pH of at least 7; therefore the compositions can comprise a pH-adjusting detergency builder component selected from water-soluble alkaline inorganic salts and water-soluble organic or inorganic builders. A wash solution pH of from 7 to about 13, preferably from about 8 to about 12, more preferably from about 8 to about 11.0 is desirable. The pH-adjusting component are selected so that when the detergent composition is dissolved in water at a concentration of 2000–6000 ppm, the pH remains in the ranges discussed above. The preferred non phosphate pH-adjusting component embodiments of the invention is selected from the group consisting of (i) sodium/potassium carbonate or sesquicarbonate (ii) sodium/potassium citrate (iii) citric acid (iv) sodium/potassium bicarbonate (v) sodium/potassium borate, preferably borax (vi) sodium/potassium hydroxide;

(vii) sodium/potassium silicate and (viii) mixtures of (i)–(vii).

Illustrative of highly preferred pH-adjusting component systems are binary mixtures of granular sodium citrate dihyrate with anhydrous sodium carbonate, and three-component mixtures of granular sodium citrate dihydrate, sodium carbonate and sodium disilicate.

The amount of the pH adjusting component included in the detergent compositions is generally from about 0.9% to about 99%, preferably from about 5% to about 70%, more preferably from about 20% to about 60% by weight of the composition.

Any pH-adjusting system can be complemented (i.e. for improved sequestration in hard water) by other optional detergency builder salts selected from phosphate or non-phosphate detergency builders known in the art, which include the various water-soluble, alkali metal, ammonium or substituted ammonium borates, hydroxysulfonates, polyacetates, and polycarboxylates. Preferred are the alkali metal, especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid, ethylenediamine disuccinic acid (especially the S,S- form); nitrilotriacetic acid, tartrate monosuccinic acid, tartrate disuccinic acid, oxydiacetic acid, oxydisuccinic acid, carboxymethyloxysuccinic acid, mellitic acid, and sodium benzene polycarboxylate salts.

The detergency builders can be any of the detergency builders known in the art, which include the various water-soluble, alkali metal, ammonium or substituted ammonium phosphates, polyphosphates, phosphonates, polyphosphonates, carbonates, borates, polyhydroxysulfonates, polyacetates, carboxylates (e.g. citrates), aluminosilicates and polycarboxylates. Preferred are the alkali metal, especially sodium, salts of the above and mixtures thereof.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1, 1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137, 3,400,176 and 3,400,148, incorporated herein by reference.

Non-phosphate detergency builders include but are not limited to the various water-soluble, alkali metal, ammonium or substituted ammonium borates, hydroxysulfonates, polyacetates, and polycarboxylates. Preferred are the alkali metal, especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid, ethylenediamine disuccinic acid (especially the S,S- form); nitrilotriacetic acid, tartrate monosuccinic acid, tartrate disuccinic acid, oxydisuccinic acid, carboxymethyloxysuccinic acid, mellitic acid, and sodium benzene polycarboxylate salts.

In general, the pH values of the detergent compositions can vary during the course of the wash as a result of the water and soil present. The best procedure for determining whether a given composition has the herein-indicated pH values is as follows: prepare an aqueous solution or dispersion of all the ingredients of the composition by mixing them in finely divided form with the required amount of water to have a 3000 ppm total concentration. Measure the pH using a conventional glass electrode at ambient temperature, within about 2 minutes of forming the solution or dispersion. To be clear, this procedure relates to pH measurement and is not intended to be construed as limiting of the detergent compositions in any way; for example, it is clearly envisaged that fully-formulated embodiments of the instant detergent compositions may comprise a variety of ingredients applied as coatings to other ingredients.

Other Optional Bleaches

The detergent compositions preferably contain other bleaching sources besides the diacyl peroxide-containing composite particulates.

For example oxygen bleach can be employed in an amount sufficient to provide from 0.01% to about 8%, preferably from about 0.1% to about 5.0%, more preferably from about 0.3% to about 4.0%, most preferably from about 0.8% to about 3% of available oxygen (AvO) by weight of the detergent composition.

Available oxygen of a detergent composition or a bleach component is the equivalent bleaching oxygen content thereof expressed as % oxygen. For example, commercially available sodium perborate monohydrate typically has an available oxygen content for bleaching purposes of about 15% (theory predicts a maximum of about 16%). Methods for determining available oxygen of a formula after manufacture share similar chemical principles but depend on whether the oxygen bleach incorporated therein is a simple hydrogen peroxide source such as sodium perborate or percarbonate, is an activated type (e.g., perborate with tetra-acetyl ethylenediamine) or comprises a performed peracid such as monoperphthalic acid. Analysis of peroxygen compounds is well-known in the art: see, for example, the publications of Swern, such as "Organic Peroxides", Vol. I, D. H. Swern, Editor; Wiley, New York, 1970, LC #72-84965, incorporated by reference. See for example the calculation of "percent active oxygen" at page 499. This term is equivalent to the terms "available oxygen" or "percent available oxygen" as used herein.

The peroxygen bleaching systems useful herein are those capable of yielding hydrogen peroxide in an aqueous liquor. These compounds include but are not limited to the alkali metal peroxides, organic peroxide bleaching compounds such as urea peroxide and inorganic persalt bleaching compounds such as the alkali metal perborates, percarbonates, perphosphates, and the like. Mixtures of two or more such bleaching compounds can also be used.

Preferred peroxygen bleaching compounds include sodium perborate, commercially available in the form of mono-, tri-, and tetra-hydrate, sodium pyrophosphate peroxyhydrate, urea peroxyhydrate, sodium percarbonate, and sodium peroxide. Particularly preferred are sodium perborate tetrahydrate, sodium perborate monohydrate and sodium percarbonate. Percarbonate is especially preferred.

Suitable oxygen-type bleaches are further described in U.S. Pat. No. 4,412,934 (Chung et al), issued Nov. 1, 1983, and peroxyacid bleaches described in European Patent Application 033,259. Sagel et al, published Sep. 13, 1989, both incorporated herein by reference, can be used.

Highly preferred percarbonate can be in uncoated or coated form. The average particle size of uncoated percarbonate ranges from about 400 to about 1200 microns, most preferably from about 400 to about 600 microns. If coated percarbonate is used, the preferred coating materials include carbonate, sulfate, silicate, borosilicate, fatty carboxylic acids, and mixtures thereof.

An inorganic chlorine bleach ingredient such as chlorinated trisodium phosphate can be utilized, but organic chlorine bleaches such as the chlorocyanurates are preferred. Water-soluble dichlorocyanurates such as sodium or potassium dichloroisocyanurate dihydrate are particularly preferred.

Available chlorine of a detergent composition or a bleach component is the equivalent bleaching chlorine content thereof expressed as % equivalent $Cl_2$ by weight. The chlorine bleach is typically present at a level of from about 0.01% to about 8% as available chlorine of chlorine bleach.

Preferably, the optional peroxygen bleach component the composition is formulated with an activator (peracid precursor). The activator is present at levels of from about 0.01% to about 15%, preferably from about 1% to about 10%, more preferably from about 1% to about 8%, by weight of the composition. Preferred activators are selected from the group consisting of tetraacetyl ethylene diamin (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzolyvalerolactam (BZVL), octanoyloxybenzenesulphonate ($C_8$-OBS), perhydrolyzable esters and mixtures thereof, most preferably benzoylcaprolactam and benzolyvalerolactam. Particularly preferred bleach activators in the pH range from about 8 to about 9.5 are those selected having an OBS or VL leaving group.

Preferred bleach activators are those described in U.S. Pat. No. 5,130,045, Mitchell et al, and U.S. Pat. No. 4,412,934, Chung et al, and copending patent applications U.S. Ser. Nos. 08/064,624, 08/064,623, 08/064,621, 08/064,562, 08/064,564, 08/082,270 and copending application to M. Burns, A. D. Willey, R. T. Hartshorn, C. K. Ghosh, entitled "Bleaching Compounds Comprising Peroxyacid Activators Used With Enzymes" and having U.S. Ser. No. 08/133,691 (P&G Case 4890R), all of which are incorporated herein by reference.

The mole ratio of peroxygen bleaching compound (as AvO) to bleach activator in the present invention generally ranges from at least 1:1, preferably from about 20:1 to about 1:1, more preferably from about 10:1 to about 3:1.

Quaternary substituted bleach activators may also be included. The present detergent composition compositions comprise a quaternary substituted bleach activator (QSBA) or a quaternary substituted peracid (QSP); more preferably, the former. Preferred QSBA structures are further described in copending U.S. Ser. No. 08/298,903, 08/298,650, 08/298,906 and 08/298,904 filed Aug. 31, 1994, incorporated herein by reference.

Bleach Catalyst

The bleach catalyst material which is an optional but preferable ingredient, can comprise the free acid form, the salts, and the like.

One type of bleach catalyst is a catalyst system comprising a transition metal cation of defined bleach catalytic activity, such as copper, iron, titanium, ruthenium tungsten, molybenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

Other types of bleach catalysts include the manganese-based complexes disclosed in U.S. Pat. Nos. 5,246,621 and 5,244,594. Preferred examples of theses catalysts include $Mn^{IV}{}_2(u\text{-}O)_3$(1,4,7-trimethyl-1,4,7-triazacyclononane)$_2$-$(PF_6)_2$, $Mn^{III}{}_2(u\text{-}O)_1(u\text{-}OAc)_2$(1,4,7-trimethyl-1,4,7-triazacyclononane)$_2$-$(ClO_4)_2$, $Mn^{IV}{}_4(u\text{-}O)_6$(1,4,7-triazacyclononane)$_4$-$(ClO_4)_2$, $Mn^{III}Mn^{IV}{}_4(u\text{-}O)_1(u\text{-}OAc)_2$ (1,4,7-trimethyl-1,4,7-triazacyclononane)$_2$-$(ClO_4)_3$, and mixtures thereof Others are described in European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, and mixtures thereof.

The bleach catalysts useful in automatic dishwashing compositions and concentrated powder detergent compositions may also be selected as appropriate for the present invention. For examples of suitable bleach catalysts see U.S. Pat. Nos. 4,246,612 and 5,227,084.

See also U.S. Pat. No. 5,194,416 which teaches mononuclear manganese (IV) complexes such as Mn(1,4,7-trimethyl-1,4,7-triazacyclononane($OCH_3$)$_3$.($PF_6$).

Still another type of bleach catalyst, as disclosed in U.S. Pat. No. 5,114,606, is a water-soluble complex of manganese (II), (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand. Said ligands are of the formula:

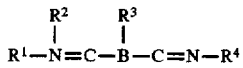

wherein $R^1$, $R^2$, $R^3$, and $R^4$ can each be selected from H, substituted alkyl and aryl groups such that each $R^1$—N=C—$R^2$ and $R^3$—C=N—$R^4$ form a five or six-membered ring. Said ring can further be substituted. B is a bridging group selected from O, S, $CR^5R^6$, $NR^7$ and C=O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe,-bispyridylmethane and -bispyridylamine complexes. Highly preferred catalysts include Co(2,2'-bispyridylamine)$Cl_2$, Di(isothiocyanato) bispyridylamine-cobalt (II), trisdipyridylamine-cobalt(II) perchlorate, Co(2,2-bispyridylamine)$_2O_2ClO_4$, Bis-(2,2'-bispyridylamine) copper(II) perchlorate, tris(di-2-pyridylamine) iron(II) perchlorate, and mixtures thereof Other examples include Mn gluconate, $Mn(CF_3SO_3)_2$, $Co(NH_3)_5Cl$, and the binuclear Mn complexed with tetra-N-dentate and bi-N-dentate ligands, including $N_4Mn^{III}(u\text{-}O)_2Mn^{IV}N_4)^+$and $[Bipy_2Mn^{III}(u\text{-}O)_2Mn^{IV}bipy_2]\text{-}(ClO_4)_3$.

The bleach catalysts may also be prepared by combining a water-soluble ligand with a water-soluble manganese salt in aqueous media and concentrating the resulting mixture by evaporation. Any convenient water-soluble salt of manganese can be used herein. Manganese (II), (III), (IV) and/or (V) is readily available on a commercial scale. In some instances, sufficient manganese may be present in the wash liquor, but, in general, it is preferred to detergent composition Mn cations in the compositions to ensure its presence in catalytically-effective amounts. Thus, the sodium salt of the ligand and a member selected from the group consisting of $MnSO_4$, $Mn(ClO_4)_2$ or $MnCl_2$ (least preferred) are dissolved in water at molar ratios of ligand:Mn salt in the range of about 1:4 to 4:1 at neutral or slightly alkaline pH. The water may first be de-oxygenated by boiling and cooled by spraying with nitrogen. The resulting solution is evaporated (under $N_2$, if desired) and the resulting solids are used in the bleaching and detergent compositions herein without further purification.

In an alternate mode, the water-soluble manganese source, such as $MnSO_4$, is added to the bleach/cleaning composition or to the aqueous bleaching/cleaning bath which comprises the ligand. Some type of complex is apparently formed in situ, and improved bleach performance is secured. In such an in situ process, it is convenient to use a considerable molar excess of the ligand over the manganese, and mole ratios of ligand:Mn typically are 3:1 to 15:1. The additional ligand also serves to scavenge vagrant metal ions such as iron and copper, thereby protecting the bleach from decomposition. One possible such system is described in European patent application, publication no. 549,271.

While the structures of the bleach-catalyzing manganese complexes of the present invention have not been elucidated, it may be speculated that they comprise chelates or other hydrated coordination complexes which result from the interaction of the carboxyl and nitrogen atoms of the ligand with the manganese cation. Likewise, the oxidation state of the manganese cation during the catalytic process is not known with certainty, and may be the (+II), (+III), (+IV) or (+V) valence state. Due to the ligands' possible six points of attachment to the manganese cation, it may be reasonably speculated that multi-nuclear species and/or "cage" structures may exist in the aqueous bleaching media. Whatever the form of the active Mn-ligand species which actually exists, it functions in an apparently catalytic manner to provide improved bleaching performances on stubborn stains such as tea, ketchup, coffee, wine, juice, and the like.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Silicates

The compositions of the type described herein optionally, but preferably comprise alkali metal silicates and/or metasilicates. The alkali metal silicates hereinafter described provide pH adjusting capability (as described above), protection against corrosion of metals and against attack on dishware, inhibition of corrosion to glasswares and chinawares. The $SiO_2$ level is from about 0.5% to about 20%, preferably from about 1% to about 15%, more preferably from about 2% to about 12%, most preferably from about 3% to about 10%, based on the weight of the detergent composition.

The ratio of $SiO_2$ to the alkali metal oxide ($M_2O$, where M=alkali metal) is typically from about 1 to about 3.2, preferably from about 1 to about 3, more preferably from about 1 to about 2.4. Preferably, the alkali metal silicate is hydrous, having from about 15% to about 25% water, more preferably, from about 17% to about 20%.

Anhydrous forms of the alkali metal silicates with a $SiO_2$:$M_2O$ ratio of 2.0 or more are also less preferred because they tend to be significantly less soluble than the hydrous alkali metal silicates having the same ratio.

Sodium and potassium, and especially sodium, silicates are preferred. A particularly preferred alkali metal silicate is a granular hydrous sodium silicate having a $SiO_2$:$Na_2O$ ratio of from 2.0 to 2.4 available from PQ Corporation, named Britesil H2O and Britesil H24. Most preferred is a granular hydrous sodium silicate having a $SiO_2$:$Na_2O$ ratio of 2.0. While typical forms, i.e. powder and granular, of hydrous silicate particles are suitable, preferred silicate particles have a mean particle size between about 300 and about 900 microns with less than 40% smaller than 150 microns and less than 5% larger than 1700 microns. Particularly preferred is a silicate particle with a mean particle size between about 400 and about 700 microns with less than 20% smaller than 150 microns and less than 1% larger than 1700 microns.

Other suitable silicates include the crystalline layered sodium silicates have the general formula:

$$NaMSi_xO_{2x+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purpose of the present invention, x in the general formula above has a value of 2, 3 or 4. The most preferred material is δ-$Na_2Si_2O_5$, available from Hoechst AG as NaSKS-6.

The crystalline layered sodium silicate material is preferably present in granular detergent compositions as a particulate in intimate admixture with a solid, water-soluble ionisable material. The solid, water-soluble ionisable material is selected from organic acids, organic and inorganic acid salts and mixtures thereof.

Dispersant Polymers

When present, a dispersant polymer in the instant detergent compositions is typically present in the range from 0 to about 25%, preferably from about 0.5% to about 20%, more preferably from about 1% to about 7% by weight of the detergent composition. Dispersant polymers are also useful for improved filming performance of the present detergent compositions, especially in higher pH embodiments, such as those in which wash pH exceeds about 9.5. Particularly preferred are polymers which inhibit the deposition of calcium carbonate or magnesium silicate on dishware.

Dispersant polymers suitable for use herein are illustrated by the film-forming polymers described in U.S. Pat. No. 4,379,080 (Murphy), issued Apr. 5, 1983, incorporated herein by reference.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1000 to about 500,000, more preferably is from about 1000 to about 250,000, and most preferably, especially if the detergent composition is for use in North American automatic dishwashing appliances, is from about 1000 to about 5,000.

Other suitable dispersant polymers include those disclosed in U.S. Patent No. 3,308,067 issued Mar. 7, 1967, to Diehl, incorporated herein by reference. Unsaturated monomeric acids that can be polymerized to form suitable dispersant polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Copolymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula: —[($C(R^2)C(R^1)(C(O)OR^3)$]— wherein the incomplete valences inside the square braces are hydrogen and at least one of the substituents $R^1$, $R^2$ or $R^3$, preferably $R^1$ or $R^2$, is a 1 to 4 carbon alkyl or hydroxyalkyl group, $R^1$ or $R^2$ can be a hydrogen and $R^3$ can be a hydrogen or alkali metal salt. Most preferred is a substituted acrylic monomer wherein $R^1$ is methyl, $R^2$ is hydrogen and $R^3$ is sodium.

The low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of 3 500 and is the fully neutralized form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535, both incorporated herein by reference.

Other dispersant polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30° to about 100° C. can be obtained at molecular weights of 1450, 3400, 4500, 6000, 7400, 9500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol. The polyethylene, polypropylene and mixed glycols are referred to using the formula $HO(CH_2CH_2O)_m(CH_2CH(CH_3)O)_n(CH(CH_3)CH_20)OH$ wherein m, n, and o are integers satisfying the molecular weight and temperature requirements given above.

Yet other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat No. 3,803,285, Jensen, issued Apr. 9, 1974; the carboxylated starches described in U.S. Pat. No. 3,629,121, Eldib, issued Dec. 21, 1971; and the dextrin starches described in U.S. Pat. No. 4,141,841, McDanald, issued Feb. 27, 1979; all incorporated herein by reference. Preferred cellulose-derived dispersant polymers are the carboxymethyl celluloses.

Yet another group of acceptable dispersants are the organic dispersant polymers, such as polyaspartate.

Low-Foaming Nonionic Surfactant

Detergent compositions of the present invention can comprise low foaming nonionic surfactants (LFNIs). LFNI can be present in amounts from 0 to about 10% by weight, preferably from about 1% to about 8%, more preferably from about 0.25% to about 4%. LFNIs are most typically used in detergent compositions on account of the improved water-sheeting action (especially from glass) which they confer to the detergent composition product. They also encompass non-silicone, nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene reverse block polymers. The PO/EO/PO polymer-type surfactants are well-known to have foam suppressing or defoaming action, especially in relation to common food soil ingredients such as egg.

The invention encompasses preferred embodiments wherein LFNI is present, and wherein this component is solid at temperatures below about 100° F., more preferably below about 120° F.

In a preferred embodiment, the LFNI is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16}$–$C_{20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4,223,163, issued Sep. 16, 1980, Builloty, incorporated herein by reference.

Highly preferred detergent compositions herein wherein the LFNI is present make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 80%, preferably from about 30% to about 70%, of the total LFNI.

Suitable block polyoxyethylene-polyoxypropylene polymeric compounds that meet the requirements described herein before include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12-18}$ aliphatic alcohols, do not generally provide satisfactory suds control in the instant detergent compositions. Certain of the block polymer surfactant compounds designated PLURONIC® and TETRONIC® by the BASF-Wyandotte Corp., Wyandotte, Mich., are suitable in detergent composition compositions herein.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene initiated with trimethylolpropane and containing 99 moles of propylene oxide and 24 moles of ethylene oxide per mole of trimethylolpropane.

Suitable for use as LFNI in the detergent composition compositions are those LFNI having relatively low cloud points and high hydrophilic-lipophilic balance (HLB). Cloud points of 1% solutions in water are typically below about 32° C. and preferably lower, e.g., 0° C., for optimum control of sudsing throughout a full range of water temperatures.

LFNIs which may also be used include a $C_{18}$ alcohol polyethoxylate, having a degree of ethoxylation of about 8, commercially available SLF18 from Olin Corp. and any biodegradable LFNI having the melting point properties discussed herein above.

Anionic Co-surfactant

The automatic dishwashing detergent compositions herein can additionally contain an anionic co-surfactant. When present, the anionic co-surfactant is typically in an amount from 0 to about 10%, preferably from about 0.1% to about 8%, more preferably from about 0.5% to about 5%, by weight of the detergent composition composition.

Suitable anionic co-surfactants include branched or linear alkyl sulfates and sulfonates. These may contain from about 8 to about 20 carbon atoms. Other anionic cosurfactants include the alkyl benzene sulfonates containing from about 6 to about 13 carbon atoms in the alkyl group, and mono- and/or dialkyl phenyl oxide mono- and/or di-sulfonates wherein the alkyl groups contain from about 6 to about 16 carbon atoms. All of these anionic co-surfactants are used as stable salts, preferably sodium and/or potassium.

Preferred anionic co-surfactants include sulfobetaines, betaines, alkyl(polyethoxy)sulfates (AES) and alkyl (polyethoxy)carboxylates which are usually high sudsing. Optional anionic co-surfactants are further illustrated in published British Patent Application No. 2,116,199A; U.S. Pat. No. 4,005,027, Hartman; U.S. Pat. No. 4,116,851, Rupe et al; and U.S. Pat. No. 4,116,849, Leikhim, all of which are incorporated herein by reference.

Preferred alkyl(polyethoxy)sulfate surfactants comprise a primary alkyl ethoxy sulfate derived from the condensation product of a $C_6$–$C_{18}$ alcohol with an average of from about 0.5 to about 20, preferably from about 0.5 to about 5, ethylene oxide groups. The $C_6$–$C_{18}$alcohol itself is preferable commercially available. $C_{12}$–$C_{15}$ alkyl sulfate which has been ethoxylated with from about 1 to about 5 moles of ethylene oxide per molecule is preferred. Where the compositions of the invention are formulated to have a pH of between 6.5 to 9.3, preferably between 8.0 to 9, wherein the pH is defined herein to be the pH of a 1% solution of the composition measured at 20° C., surprisingly robust soil removal, particularly proteolytic soil removal, is obtained when $C_{10}$–$C_{18}$ alkyl ethoxysulfate surfactant, with an average degree of ethoxylation of from 0.5 to 5 is incorporated into the composition in combination with a proteolytic enzyme, such as neutral or alkaline proteases at a level of active enzyme of from 0.005% to 2%. Preferred alkyl (polyethoxy)sulfate surfactants for inclusion in the present invention are the $C_{12}$–$C_{15}$ alkyl ethoxysulfate surfactants with an average degree of ethoxylation of from 1 to 5, preferably 2 to 4, most preferably 3.

Conventional base-catalyzed ethoxylation processes to produce an average degree of ethoxylation of 12 result in a distribution of individual ethoxylates ranging from 1 to 15 ethoxy groups per mole of alcohol, so that the desired average can be obtained in a variety of ways. Blends can be made of material having different degrees of ethoxylation and/or different ethoxylate distributions arising from the specific ethoxylation techniques employed and subsequent processing steps such as distillation.

Alkyl(polyethoxy)carboxylates suitable for use herein include those with the formula $RO(CH_2CH_2O)x\ CH_2COO—M^+$ wherein R is a $C_6$ to $C_{25}$ alkyl group, x ranges from 0 to 10, preferably chosen from alkali metal, alkaline earth metal, ammonium, mono-, di-, and tri-ethanolammonium, most preferably from sodium, potassium, ammonium and mixtures thereof with magnesium ions. The preferred alkyl(polyethoxy)carboxylates are those where R is a $C_{12}$ to $C_{18}$ alkyl group.

Highly preferred anionic cosurfactants herein are sodium or potassium salt-forms for which the corresponding calcium salt form has a low Kraft temperature, e.g., 30° C. or below, or, even better, 20° C. or lower. Examples of such highly preferred anionic cosurfactants are the alkyl (polyethoxy)sulfates.

Detersive Enzymes (including enzyme adjuncts)

The detergent compositions optionally contain from 0 to about 8%, preferably from about 0.001% to about 5%, more preferably from about 0.003% to about 4%, most preferably from about 0.005% to about 3%, by weight, of active detersive enzyme. The knowledgeable formulator will appreciate that different enzymes should be selected depending on the pH range of the detergent composition composition. Thus, Savinase® may be preferred in the instant compositions when formulated to deliver wash pH of 10, whereas Alcalase® may be preferred when the detergent compositions deliver wash pH of, say, 8 to 9. Moreover, the formulator will generally select enzyme variants with enhanced bleach compatibility when formulating oxygen bleaches containing compositions.

In general, the preferred detersive enzyme herein is selected from the group consisting of proteases, amylases, lipases and mixtures thereof. Most preferred are proteases or amylases or mixtures thereof.

The proteolytic enzyme can be of animal, vegetable or microorganism (preferred) origin. More preferred is serine proteolytic enzyme of bacterial origin. Purified or nonpurified forms of enzyme may be used. Proteolytic enzymes produced by chemically or genetically modified mutants are included by definition, as are close structural enzyme variants. Particularly preferred by way of proteolytic enzyme is bacterial serine proteolytic enzyme obtained from Bacillus, *Bacillus subtilis* and/or *Bacillus licheniformis*. Suitable commercial proteolytic enzymes include Alcalase®, Esperase®, Durazym®, Savinase®, Maxatase®, Maxacal®, and Maxapem® 15 (protein engineered Maxacal); Purafect® and subtilisin BPN and BPN' are also commercially available. Preferred proteolytic enzymes also encompass modified bacterial serine proteases, such as those described in European Patent Application Ser. No. 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme which is called "Protease A" herein. Most preferred is what is called herein "Protease C", which is a triple variant of an alkaline serine protease from Bacillus in which tyrosine replaced valine at position 104, serine replaced asparagine at position 123, and alanine replaced threonine at position 274. Protease C is described in EP 90915958:4, corresponding to WO 91/06637, Published May 16, 1991, which is incorporated herein by reference. Genetically modified variants, particularly of Protease C, are also included herein. Some preferred proteolytic enzymes are selected from the group consisting of Savinase®, Esperase®, Maxacal®, Purafect®, BPN', Protease A and Protease B, and mixtures thereof. Bacterial serine protease enzymes obtained from *Bacillus subtilis* and/or *Bacillus licheniformis* are preferred. An especially preferred protease herein referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76 in combination with one or more amino acid residue position equivalent to those selected from the group consisting of +99, +101, +103, +107 and +123 in Bacillus amyloliquefaciens subtilisin as described in the concurrently filed patent application of A. Baeck, C. K. Ghosh, P. P. Greycar, R. R. Bott and L. J. Wilson, entitled "Protease-Containing Cleaning Compositions" and having U.S. Ser. No. 08/136,797 (P&G Case 5040). This application is incorporated herein by reference.

Preferred lipase-containing compositions comprise from about 0.001 to about 0.01% lipase, from about 2% to about 5% amine oxide and from about 1% to about 3% low foaming nonionic surfactant.

Suitable lipases for use herein include those of bacterial, animal, and fungal origin, including those from chemically or genetically modified mutants. Suitable bacterial lipases include those produced by Pseudomonas, such as *Pseudomonas stutzeri* ATCC 19.154, as disclosed in British Patent 1,372,034, incorporated herein by reference. Suitable lipases include those which show a positive immunological cross-reaction with the antibody of the lipase produced from the microorganism *Pseudomonas fluorescens* IAM 1057. This lipase and a method for its purification have been described in Japanese Patent Application 53-20487, laid open on Feb. 24, 1978, which is incorporated herein by reference. This lipase is available under the trade name Lipase P "Amano," hereinafter referred to as "Amano-P." Such lipases should show a positive immunological cross reaction with the Amano-P antibody, using the standard and well-known immunodiffusion procedure according to Oucheterlon (Acta. Med. Scan., 133, pages 76–79 (1950)). These lipases, and a method for their immunological cross-reaction with Amano-P, are also described in U.S. Pat. No. 4,707,291, Thom et al., issued Nov. 17, 1987, incorporated herein by reference. Typical examples thereof are the Amano-P lipase, the lipase ex *Pseudomonas fragi* FERM P 1339 (available under the trade name Amano-B), lipase ex *Pseudomonas nitroreducens* var. lipolyticum FERM P 1338 (available under the trade name Amano-CES), lipases ex *Chromobacter viscosum* var. lipolyticum NRRlb 3673, and further *Chromobacter viscosum* lipases, and lipases ex *Pseudomonas gladioli*. A preferred lipase is derived from *Pseudomonas pseudoalcaligenes*, which is described in Granted European Patent, EP-B-0218272. Other lipases of interest are Amano AKG and *Bacillis Sp* lipase (e.g. Solvay enzymes). Additional lipases which are of interest where they are compatible with the composition are those described in EP A 0 339 681, published Nov. 28, 1990, EP A 0 385 401, published Sep. 5, 1990, EO A 0 218 272, published Apr. 15, 1987, and PCT/DK 88/00177, published May 18, 1989, all incorporated herein by reference.

Suitable fungal lipases include those produced by *Humicola lanuginosa* and *Thermomyces lanuginosus*. Most preferred is lipase obtained by cloning the gene from *Humicola lanuginosa* and expressing the gene in *Aspergillus oryzae* as described in European Patent Application 0 258 068, incorporated herein by reference, commercially available under the trade name Lipolase from Novo-Nordisk.

Any amylase suitable for use in a dishwashing detergent composition can be used in these compositions. Amylases include for example, 2-amylases obtained from a special strain of *B. licheniforms*, described in more detail in British Patent Specification No. 1,296,839. Amylolytic enzymes include, for example, Rapidase™, Maxamyl™, Termamyl™ and BAN™. In a preferred embodiment, from about 0.001% to about 5%, preferably 0.005% to about 3%, by weight of active amylase can be used. Preferably from about 0.005% to about 3% by weight of active protease can be used. Preferably the amylase is Maxamyl™ and/or Termamyl™ and the protease is Savinase® and/or protease B. As in the case of proteases, the formulator will use ordinary skill in selecting amylases or lipases which exhibit good activity within the pH range of the detergent composition composition.

Stability—Enhanced Amylase—Engineering of enzymes for improved stability, e.g., oxidative stability is known. See, for example J. Biological Chem., Vol. 260, No. 11, June 1985, pp 6518–6521.

"Reference amylase" hereinafter refers to an amylase outside the scope of the amylase component of this invention and against which stability of an amylase within the invention can be measured.

The present invention also can makes use of amylases having improved stability in detergents, especially improved oxidative stability. A convenient absolute stability reference-point against which amylases used in the instant invention represent a measurable improvement is the stability of TERMAMYL (R) in commercial use in 1993 and available from Novo Nordisk A/S. This TERMAMYL (R) amylase is a "reference amylase". Amylases within the spirit and scope of the present invention share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, all measured versus the above-identified reference-amylase. Preferred amylases herein can demonstrate further improvement versus more challenging reference amylases, the latter reference amylases being illustrated by any of the precursor amylases of which the amylases within the invention are variants. Such precursor amylases may themselves be natural or be the product of genetic engineering. Stability can be measured using any of the art-disclosed technical tests. See references disclosed in WO 94/02597, itself and documents therein referred to being incorporated by reference.

In general, stability-enhanced amylases respecting the invention can be obtained from Novo Nordisk A/S, or from Genencor International.

Preferred amylases herein have the commonality of being derived using site-directed mutagenesis from one or more of the *Baccillus amylases*, especially the *Bacillus alpha-amylases*, regardless of whether one, two or multiple amylase strains are the immediate precursors.

As noted, "oxidative stability-enhanced" amylases are preferred for use herein. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *B.licheniformis* alpha-amylase, known as TERMAMYL (R), or the homologous position variation of a similar parent amylase, such as *B. amyloliquefaciens, B.subtilis*, or *B.stearothermophilus;*

(b) Stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B.licheniformis* NCIB8061. Methionine (Met) was identified as the most likely residue to be modified. Met was substituted, one at a time, in positions 8,15,197,256,304,366 and 438 leading to specific mutants, particularly important being M197L and M197T with the M197T variant being the most stable expressed variant.

(c) Particularly preferred herein are amylase variants having additional modification in the immediate parent available from Novo Nordisk A/S. These amylases do not yet have a tradename but are those referred to by the supplier as QL37+M197T.

Any other oxidative stability-enhanced amylase can be used, for example as derived by site-directed mutagenesis from known chimeric, hybrid or simple mutant parent forms of available amylases.

Enzyme Stabilizing System

The detergent compositions herein may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are widely available, indeed ubiquitous, and are illustrated by salts containing ammonium cations or sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc. and mixtures thereof can be used if desired. In general, since the chlorine scavenger function can be performed by several of the ingredients separately listed under better recognized functions, (e.g., other components of the invention including oxygen bleaches), there is no requirement to detergent composition a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any scavenger which is extremely incompatible with other optional ingredients, if used. For example, formulation chemists generally recognize that combinations of reducing agents such as thiosulfate with strong oxidizers such as percarbonate are not wisely made unless the reducing agent is protected from the oxidizing agent in the solid-form detergent composition composition. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

Silicone and Phosphate Ester Suds Suppressors

The detergent compositions optionally contain an alkyl phosphate ester suds suppressor, a silicone suds suppressor, or combinations thereof. Levels in general are from 0% to about 10%, preferably, from about 0.001% to about 5%. Typical levels tend to be low, e.g., from about 0.01% to about 3% when a silicone suds suppressor is used. Preferred non-phosphate compositions omit the phosphate ester component entirely.

Silicone suds suppressor technology and other defoaming agents useful herein are extensively documented in "Defoaming, Theory and Industrial Applications", Ed., P. R. Garrett, Marcel Dekker, N.Y., 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/ silica, 18% stearyl alcohol and 70% starch in granular form. A suitable commercial source of the silicone active compounds is Dow Corning Corp.

Levels of the suds suppressor depend to some extent on the sudsing tendency of the composition, for example, an detergent composition for use at 2000 ppm comprising 2% octadecyldimethylamine oxide may not require the presence of a suds suppressor. Indeed, it is an advantage of the present invention to select cleaning-effective amine oxides which are inherently much lower in foam-forming tendencies than the typical coco amine oxides. In contrast, formulations in which amine oxide is combined with a high-foaming anionic cosurfactant, e.g., alkyl ethoxy sulfate, benefit greatly from the presence of suds suppressors.

Phosphate esters have also been asserted to provide some protection of silver and silver-plated utensil surfaces, however, the instant compositions can have excellent silvercare without a phosphate ester component. Without being limited by theory, it is believed that lower pH formulations, e.g., those having pH of 9.5 and below, plus the presence of the essential amine oxide, both contribute to improved silver care.

If it is desired nonetheless to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

It has been found preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

Corrosion Inhibitor

The detergent compositions may contain a corrosion inhibitor. Such corrosion inhibitors are preferred components of automatic dishwashing compositions in accord with the invention, and are preferably incorporated at a level of from 0.05% to 10%, preferably from 0.1% to 5% by weight of the total composition.

Suitable corrosion inhibitors include paraffin oil typically a predominantly branched aliphatic hydrocarbon having a number of carbon atoms in the range of from 20 to 50: preferred paraffin oil selected from predominantly branched $C_{25-45}$ species with a ratio of cyclic to noncyclic hydrocarbons of about 32:68; a paraffin oil meeting these characteristics is sold by Wintershall, Salzbergen, Germany, under the trade name WINOG 70.

Other suitable corrosion inhibitor compounds include benzotriazole and any derivatives thereof, mercaptans and diols, especially mercaptans with 4 to 20 carbon atoms including lauryl mercaptan, thiophenol, thionapthol, thionalide and thioanthranol. Also suitable are the $C_{12}$–$C_{20}$ fatty acids, or their salts, especially aluminum tristearate. The $C_{12}$–$C_{20}$ hydroxy fatty acids, or their salts, are also suitable. Phosphonated octa-decane and other anti-oxidants such as betahydroxytoluene (BHT) are also suitable.

Other Optional Adjuncts

Depending on whether a greater or lesser degree of compactness is required, filler materials can also be present in the detergent compositions. These include sucrose, sucrose esters, sodium chloride, sodium sulfate, potassium chloride, potassium sulfate, etc., in amounts up to about 70%, preferably from 0% to about 40% of the detergent composition composition. A preferred filler is sodium sulfate, especially in good grades having at most low levels of trace impurities.

Sodium sulfate used herein preferably has a purity sufficient to ensure it is non-reactive with bleach; it may also be treated with low levels of sequestrants, such as phosphonates in magnesium-salt form. Note that preferences, in terms of purity sufficient to avoid decomposing bleach, applies also to builder ingredients.

Hydrotrope materials such as sodium benzene sulfonate, sodium toluene sulfonate, sodium cumene sulfonate, etc., can be present in minor amounts.

Bleach-stable perfumes (stable as to odor); and bleach-stable dyes (such as those disclosed in U.S. Pat. No. 4,714,562, Roselle et al, issued Dec. 22, 1987); can also be added to the present compositions in appropriate amounts. Other common detergent ingredients are not excluded.

Since certain detergent compositions herein can contain water-sensitive ingredients, e.g., in embodiments comprising anhydrous amine oxides or anhydrous citric acid, it is desirable to keep the free moisture content of the detergent compositions at a minimum, e.g., 7% or less, preferably 4% or less of the detergent composition; and to provide packaging which is substantially impermeable to water and carbon dioxide. Plastic bottles, including refillable or recyclable types, as well as conventional barrier cartons or boxes are generally suitable. When ingredients are not highly compatible, e.g., mixtures of silicates and citric acid, it may further be desirable to coat at least one such ingredient with a low-foaming nonionic surfactant for protection. There are numerous waxy materials which can readily be used to form suitable coated particles of any such otherwise incompatible components.

Method for Cleaning

The detergent compositions herein may be utilized in methods for cleaning soiled tableware, especially plasticware. A preferred method comprises contacting the tableware with a pH wash aqueous medium of at least 8. The aqueous medium comprises at least about 1% diacyl peroxide. The diacyl peroxide is added in the form of the composite particulates described herein.

A preferred method for cleaning soiled tableware comprises using the diacyl peroxide-containing particulate, enzyme, low foaming surfactant and detergency builder. The aqueous medium is formed by dissolving a solid-form automatic dishwashing detergent in an automatic dishwashing machine. A particularly preferred method also includes low levels of silicate, preferably from about 3% to about 10% $SiO_2$.

EXAMPLES

The following examples are illustrative of the present invention. These examples are not meant to limit or otherwise define the scope of the invention. All parts, percentages and ratios used herein are expressed as percent weight unless otherwise specified.

Example I

Flakes containing both discrete particles of benzoyl peroxide and PEG 8000 as a carrier are made as follows, in accordance with the present invention:

Firstly, 40 grams of sodium sulfate powder are added to 240 grams of particulate benzoyl peroxide having a mean particle size of about 200 microns (sold as Lucidol 75FP (tradename) by Elf-Atochem). This mixture is added to a Cuisinart mixer and mixed for 3 seconds to obtain a uniform blend and to break-up any lumps in the bulk of the benzoyl peroxide.

Then, 720 grams of polyethylene glycol of molecular weight 8000 (PEG 8000, sold by BASF as Pluracol E-8000 prills) are placed in a half-gallon plastic tub and heated in a microwave on a high setting for 7 minutes to melt the PEG 8000. The PEG is stirred to ensure uniform consistency and complete melting. The final temperature of the molten PEG 8000 is 57° C. (135° F.).

Immediately, the previously prepared mixture of particulate benzoyl peroxide and sodium sulfate is added to the molten PEG 8000. This mixture is stirred with a spatula for 1 minute to uniformly disperse the powder in the molten PEG, thereby causing the temperature to drop to about 43° C. (110° F.) and the viscosity to increase slightly.

Immediately, the entire mixture is poured into the nip of a twin drum chill roll. The settings on the chill roll are as follows:

Gap: 0.015 mm

Speed: 50 rpm

Water Temperature: 13° C. (55° F.) (cold water from the tap)

Flakes are formed on the chill roll and scraped off by use of a doctor blade into a pan and collected.

The flakes are then reduced in size by use of a Quadro Co-mil, which is a form of cone mill, with a screen having 0.094 inch (2.39 mm) hole openings. The reduced size flakes are then sieved in 200 gram portions using a Tyler 14 mesh, a Tyler 35 mesh, and a pan in a Rotap. The portion which passes through the Tyler 14 mesh but is retained on the Tyler 35 mesh is collected as acceptable flakes (78.2% of the size-reduced flakes). 6.5% are retained on Tyler 14 mesh and rejected as "oversize"; the balance (15.3%) are rejected as "undersize."

The composition of the resultant flake is:

PEG 8000 72%

Benzoyl peroxide (active) 18%

Water 6%

Sodium Sulfate 4%

The mean particle size of the resultant flakes is 741 μm.

The particle size of the discrete benzoyl peroxide particles as delivered into an aqueous detergent solution is determined for the flakes, as prepared above, using a Coulter laser particle size analyzer. The particle size so determined is compared to particle sizes provided by the initial Lucidol 75FP starting material and to particle sizes provided by conventional large particle dibenzoyl peroxide (Lucidol 75). Results are set forth in Table I:

TABLE I

| Time in Analyzer | Lucidol 75FP | Flake | Lucidol 75 |
|---|---|---|---|
| 1.5 minutes | 201 μm | 53 μm | 645 μm |
| 10.0 minutes | 136 μm | 65 μm | 663 μm |
| 24.5 minutes | 121 μm | 67 μm | 633 μm |
| 38.0 minutes | 111 μm | 68 μm | 578 μm |

As can be seen from the Table I data, the flakes deliver a much smaller size particle to the wash solution than does conventional large particle size benzoyl peroxide raw material (Lucidol 75). Further, such flakes deliver a finer particle size than would have been achieved with the Lucidol 75FP raw material used to prepare the flakes. This is due to the additional size reduction achieved in the mixing step of the flake preparation procedure.

Example II

Flakes containing both discrete particles of benzoyl peroxide (BPO) and PEG 8000 as a carrier are made as follows, in accord with the invention:

A sample of particulate benzoyl peroxide (containing about 75% active benzoyl peroxide) having a mean particle size of about 200 microns (sold as Lucidol 75FP (tradename) by Elf-Atochem) is dried to achieve particles containing about 90% active benzoyl peroxide by air drying on a plastic tray in a hood.

27.78 grams of the resulting dried sample are weighed out. The pre-drying step ensures that any lumps present in the raw material break up easily and that there is no need for a homogenization step as in Example I.

72.22 grams of Polyethylene Glycol 8000 (PEG 8000, sold by BASF as Pluracol E-8000 prills) are placed into a half-gallon plastic tub and heated in a microwave on the high setting for 3 minutes to melt the PEG 8000. The PEG is stirred to ensure uniform consistency and complete melting. The final temperature of the molten PEG 8000 is 135° F.

Immediately, the dried sample of benzoyl peroxide is added to the molten PEG 8000. This mixture is stirred with a spatula for 1 minute to uniformly disperse the benzoyl peroxide in the molten PEG 8000.

Immediately, the entire mixture is poured into the nip of a twin drum chill roll. Settings on the chill roll are set as follows:

Gap: 0.015 mm

Speed: 50 rpm

Water Temperature: 13° C. (cold water from the tap)

Flakes are formed on the chill roll and scraped off by use of a doctor blade into a pan and collected.

The flakes are then reduced in size by use of a Quadro Co-mil, which is a form of cone mill, with a screen having 0.094 inch (2.39 mm) hole openings. The reduced size flakes are then sieved using a Tyler 14 mesh, a Tyler 35 mesh, and a pan in a Rotap. The portion which passes through the Tyler 14 mesh but is retained on the Tyler 35 mesh is collected as acceptable flakes.

The resultant flake composition is:

PEG 8000 72.22%

BPO Active 25.00%

Water 2.78%

The mean particle size of the flakes is about 700 μm.

Example III

The benzoyl peroxide composite particles in the form of flakes as prepared in Example I are incorporated into conventional automatic dishwashing detergent compositions. Such dishwashing products are then evaluated in two types of dishwasher tests wherein the performance of each product is compared against that of a similar product which utilizes, instead of the Example I flakes, conventional granular benzoyl peroxide raw material (Lucidol 75 from Elf-Atochem, 650 microns mean particle size). The two types of performance testing involve a) evaluation for residue on dishware, and b) evaluation of stain removal from plasticware.

Residue Testing a) Products Tested

Two dishwashing detergent compositions are prepared. Both are exactly the same except for the source of benzoyl peroxide. The base formula used for both is set forth in Table A:

TABLE A

| Base Formula A | |
|---|---|
| Component | Wt. % |
| Sodium carbonate | 20.0 |
| Sodium citrate (as anhydrous) | 15.0 |
| 1-Hydroxyethylidene-1,1-diphosphonic acid (HEDP) | 0.50 |
| Acusol 480N Dispersant (active) | 6.0 |
| Sodium Perborate (AvO) | 1.5 |
| Savinase 6.0T protease enzyme | 2.0 |
| Termamyl 60T amylase enzyme | 1.0 |
| 2.0 ratio Silicate ($SiO_2$) | 8.0 |
| Nonionic Surfactant (SLF-18) | 2.0 |
| Sulfate/Moisture | Balance |

TABLE A-continued

| The two products tested are as follows: | |
|---|---|
| Invention Product | Comparative Product |
| Base Formula A<br>Example I Flakes (2% Active) | Base Formula A<br>Granular Benzoyl Peroxide Raw Material (2% Active) |

b) Testing Procedure

Residue testing is performed in a KitchenAid KDI 18 dishwasher. Test conditions involve using standard city water @120° F. Normal wash settings are used for 1 cycle. Substrates in the dishwasher include glasses, plastic tumblers/mugs, and china cups.

c) Test Results

At the end of the cycle, the test substrates from the dishwasher are visually observed. No residue was formed on the substrates washed using the Invention Product. A gritty residue forms on the substrates washed using the Comparative Product. A sample of this residue is collected and found to be benzoyl peroxide.

Stain Removal Testing a) Products Tested

Three additional dishwashing detergent compositions are prepared. All are exactly the same except for the source of benzoyl peroxide. The base formula used for all three is set forth in Table B.

TABLE B

| Base Formula B | |
|---|---|
| Component | Wt. % |
| Sodium carbonate | 17.5 |
| Sodium citrate (as anhydrous) | 15.0 |
| HEDP | 1.0 |
| Acusol 480N Dispersant (active) | 6.0 |
| TAED bleach activator | 2.2 |
| Savinase 12T protease enzyme | 2.2 |
| LE 17 amylase enzyme | 1.5 |
| 2.0 ratio Silicate ($SiO_2$) | 8.0 |
| Meta silicate ($SiO_2$) | 1.25 |
| Paraffin | 0.50 |
| Bismuth nitrate | 0.30 |
| Nonionic surfactant (LF 404) | 2.0 |
| Sulfate/Moisture | Balance |

| The three products tested are: | | |
|---|---|---|
| Product A (Comparative) | Product B (Comparative) | Product C (Invention) |
| Base Formula B | Base Formula B<br>Granular Benzoyl Peroxide Raw Material (0.8% Active) | Base Formula B<br>Example I Flakes - (0.8% Active) |

b) Testing Procedure

Stain removal testing is performed as follows: Initial color readings are obtained on a controlled set of plastic items including plastic spatulas and plastic bowls using a Hunter spectrophotometer. Values are obtained for L, a, and b and are recorded as the "initial" values.

These items are then stained with a hot tomato-based sauce using a standard procedure which controls the sauce temperature, the immersion time, and the rinsing procedure.

After staining, the plastics are again measured on the Hunter spectrophotometer. Values obtained for L, a, and b, are recorded as the "stained" values.

The plastic items are then put in the dishwasher in a standard orientation. The dishwasher is then run under a selected set of conditions (hardness, temperature, soil load, etc.). After completion of the wash/dry cycles, the plastic items are removed and immediately spectrophotometer readings are made. Values obtained for L, a, and b are recorded as the "washed" values.

% stain removal is calculated as follows:

% Removal=(Delta E of stained items/Delta E of washed items)×100 where:

Delta E of stained items=Difference between stained readings and initial readings calculated as follows:

$$DE_{stained} = \sqrt{(L_s - L_i)^2 + (a_s - a_i)^2 + (b_s - b_i)^2}$$

Delta E of washed items=Difference between "washed" readings and "stained" readings calculated as follows:

$$DE_{washed} = \sqrt{(L_w - L_s)^2 + (a_w - a_s)^2 + (b_w - b_s)^2}$$

Each of the above three products are tested as per this protocol. Testing is performed in a Hotpoint dishwasher using 122° F. water (~8 gpg) with no additional soil.

c) Test Results

Stain removal testing results are shown in Table C.

TABLE C

Stain Removal Test Results

| Test Product | % Stain Removal |
|---|---|
| Product A (Comparative) | 20.0 |
| Product B (Comparative) | 34.5 |
| Product C (Invention) | 74.3 |

The Table C data indicate that the product containing the benzoyl peroxide flakes of Example I provides better stain removal performance in comparison with similar products which contain either no benzoyl peroxide or benzoyl peroxide in large particle form.

Example IV

Granular automatic dishwashing detergent compositions in accord with the invention are as follows:

TABLE 1

| Ingredients | % by weight A | B | C |
|---|---|---|---|
| Sodium Citrate (as anhydrous) | 29.00 | 15.00 | 15.00 |
| Acusol 480N[1] (as active) | 6.00 | 6.00 | 6.00 |
| Sodium carbonate | — | — | 20.00 |
| Britesil H2O (as $SiO_2$) | 17.00 | 8.00 | 8.00 |
| 1-hydroxyethylidene-1, 1-diphosphonic acid | 0.50 | 0.50 | 0.50 |
| Nonionic surfactant[2] | — | 2.00 | — |
| Nonionic surfactant[3] | 1.50 | — | 1.50 |
| Savinase 12T | 2.20 | 2.00 | 2.20 |
| Termamyl 60T | 1.50 | 1.00 | 1.50 |
| Perborate monohydrate (as AvO) | 0.30 | 1.50 | 0.30 |
| Perborate tetrahydrate (as AvO) | 0.90 | — | 0.90 |
| Composite particulate[4] | 4.50 | 4.50 | 4.50 |
| TAED | — | — | 3.00 |
| Diethylene triamine penta methylene phosphonic acid | 0.13 | — | 0.13 |
| Paraffin | 0.50 | — | 0.50 |

TABLE 1-continued

| Ingredients | % by weight A | B | C |
|---|---|---|---|
| Benzotriazole | 0.30 | — | 0.30 |
| Sulfate, water, etc. | | balance | |

[1]Dispersant from Rohm and Haas
[2]Poly Tergent SLF-18 surfactant from Olin Corporation
[3]Plurafac LF404 surfactant from BASF.
[4]The composite particulate of Example I or II.

Example V

Granular automatic dishwashing detergent compositions in accord with the invention are set forth as follows in Table 2:

TABLE 2

| Ingredients | % by weight D | E | F |
|---|---|---|---|
| Sodium Citrate (as anhydrous) | 15.00 | 15.00 | 15.00 |
| Acusol 480N[1] (active) | 6.00 | 6.00 | 6.00 |
| Sodium carbonate | 20.00 | 20.00 | 20.00 |
| Britesil H2O (as $SiO_2$) | 8.00 | 8.00 | 8.00 |
| 1-hydroxyethylidene-1, 1-diphosphonic acid | 1.00 | 1.00 | 1.00 |
| Nonionic surfactant[2] | 2.00 | 2.00 | 2.00 |
| Savinase 12T | 2.00 | 2.00 | 2.00 |
| Termamyl 60T | 1.00 | 1.00 | 1.00 |
| Perborate monohydrate (as AvO) | 1.50 | 1.50 | 1.50 |
| Composite particulate[3] | 2.00 | 4.00 | 6.00 |
| TAED | — | — | — |
| Sulfate, water, etc. | | balance | |

[1]Dispersant from Rohm and Haas
[2]Polytergent SLF-18 surfactant from Olin Corporation
[3]The composite particulate of Example I or II.

Example VI

Granular automatic dishwashing detergent compositions in accord with the invention are as follows in Table 3:

TABLE 3

| | % by weight G |
|---|---|
| Sodium TripolyPhosphate (anhydrous basis) | 29.68 |
| Nonionic Surfactant | 2.50 |
| MSAP Suds Suppressor | 0.08 |
| Sodium Carbonate | 23.00 |
| Sodium Silicate (2.4r, as $SiO_2$) | 6.50 |
| NaDCC Bleach (as $AvCl_2$) | 1.10 |
| Sodium Sulfate | 21.79 |
| [1]Composite particulate | 2.20 |
| Perfume | 0.14 |

[1]The composite particulate of Example I or II.

Example VII

Granular automatic dishwashing detergent compositions in accord with the invention are set forth as follows in Table 4:

TABLE 4

| Ingredients | % by weight | | |
|---|---|---|---|
| | H | I | J |
| Sodium Citrate (as anhydrous) | 10.00 | 15.00 | 20.00 |
| Acusol 480N[1] (active) | 6.00 | 6.00 | 6.00 |
| Sodium carbonate | 15.00 | 10.00 | 5.00 |
| Sodium tripolyphosphate | 10.00 | 10.00 | 10.00 |
| Britesil H2O (as $SiO_2$) | 8.00 | 8.00 | 8.00 |
| 1-hydroxyethylidene-1, 1-diphosphonic acid | 1.00 | 1.00 | 1.00 |
| Nonionic surfactant | | | |

What is claimed is:

1. A process for preparing diacyl peroxide-containing composite particulates especially suitable for incorporation into granular automatic dishwashing detergent products, which process comprises:

A) providing a plurality of particles comprising water-insoluble diacyl peroxide and having a mean particle size less than about 200 microns in a wash solution;

B) combining the diacyl peroxide particles of Step A) with a molten carrier material which melts in the range of from about 38° C. to 77° C., while agitating the resulting particle-carrier combination to form a substantially uniform admixture of said particles and said carrier material wherein said carrier material is polyethylene glycol having a molecular weight in the range of about 4000 to about 10,000;

C) rapidly cooling the particle-carrier admixture of Step B) to form a solidified admixture of particles and carrier material; and D) further working the solidified particle-carrier material admixture formed in Step C) if or as necessary to form composite particulates which comprise from about 1% to 50% by weight of said diacyl peroxide particles and from about 30% to 99% by weight of said carrier material and which have a mean particulate size of from about 200 to 2,400 microns.

2. A process according to claim 1 wherein the composite particulates that are prepared comprise from about 10% to 35% by weight of the diacyl peroxide particles and from about 50% to 90% by weight of the carrier material.

3. A process according to claim 2 wherein

A) the diacyl peroxide has the general formula:

$$RC(O)OO(O)CR^1$$

wherein R and $R^1$ are hydrocarbyl groups containing at least 10 carbon atoms and wherein at least one of R and $R^1$ contains an aromatic nucleus; and B) the carrier material melts within the range of from about 43° C. to 71° C. and is water soluble.

4. A process according to claim 3 wherein

A) the diacyl peroxide is di-benzoyl peroxide; and

B) the carrier is a polyethylene glycol having a molecular weight of from about 2,000 to 12,000.

5. A process according to claim 4 wherein the carrier material is polyethylene glycol having a molecular weight of about 8,000.

6. A process according to claim 3 wherein the solidified admixture of particles and carrier material is worked as necessary to form composite particulates which have a mean particulate size of from about 500 to 2,000 microns.

7. A process according to claim 6 wherein the composite particulates formed thereby additionally comprise from about 0.1% to 30% by weight of a stabilizing additive selected from inorganic salts, antioxidants, chelants, and combinations of said stabilizing additives.

8. A process according to claim 7 wherein the composite particulates formed thereby have a free water content of less than about 10%.

9. A process according to claim 3 wherein the combining/mixing Step B) and the cooling/solidification Step C) take place over a time interval of less than about 10 minutes.

10. A process according to claim 3 wherein the cooling/solidification Step C) comprises introduction of the Step B) admixture onto a chill roll or cooling belt to thereby form a layer of solid material on the roll or belt.

11. A process according to claim 10 wherein the solid material on the chill roll or roller belt is removed and further worked by comminution to form composite particulates in the form of flakes having the requisite mean particle size.

12. A process according to claim 3 wherein the cooling/solidification Step C) comprises delivering drops of the Step B) admixture through a feed orifice onto a cooling belt.

13. A process according to claim 12 wherein the size of said feed orifice is selected to favor formation of composite particulates in the form of pastilles having the requisite mean particulate size.

14. A process according to claim 3 wherein a) the combining/mixing Step B) is followed by an extrusion procedure wherein the diacyl peroxide particle-carrier material mixture is extruded through a die plate having orifices which form extrudates having the requisite mean particle size; and b) the cooling/solidification Step C) is carried out by introducing said extrudates into a cooling apparatus.

15. A process according to claim 1 a) wherein in Step A the plurality of diacyl peroxide particles is provided as an aqueous slurry or paste containing up to about 65% by weight of said slurry or paste of said diacyl peroxide particles; and b) where in during Step B at least 95% of the water introduced via said aqueous slurry or paste is removed prior to the cooling Step C.

16. A process according to claim 15 wherein the diacyl peroxide slurry or paste contains from about 30% to 50% by weight of said slurry or paste of said diacyl peroxide particles.

17. A process according to claim 7:

a) wherein in Step A the plurality of di-benzoyl peroxide particles is provided as an aqueous slurry or paste containing from about 40% to 50% by weight of said slurry or paste of said di-benzoyl peroxide particles; and b) wherein in Step B substantially all of the water introduced via said aqueous slurry or paste is removed prior to Step C.

18. Diacyl peroxide-containing composite particulates prepared by a process according to claim 1.

19. Diacyl peroxide-containing composite particulates prepared by a process according to claim 8.

20. Diacyl peroxide-containing composite particulates especially suitable for incorporation into granular automatic dishwashing detergent compositions, which composite particulates comprise A) from about 1% to 50% by weight of particles comprising water-insoluble diacyl peroxide wherein said particles have a mean particle size less than about 200 microns in a wash solution;

B) from about 30% to 99% by weight of carrier material which melts in the range of from about 38° C. to 77° C.;

and wherein said carrier material is polyethylene glycol having a molecular weight in the range of about 4000 to about 10,000; and C) no more than about 10% by weight of free water; said composite particles having a mean particulate size from about 200 to 2,400 microns.

21. Diacyl peroxide-containing composite particulates according to claim 20 wherein A) the diacyl peroxide is di-benzoyl peroxide;

B) the carrier material is polyethylene glycol having a molecular weight of from about 2,000 to 12,000; and C) the composite particulates contain no more than about 6% by weight of free water.

22. Diacyl peroxide-containing composite particulates according to claim 21 which additionally contain from about 0.1% to 30% by weight of a stabilizing additive selected from inorganic salts, antioxidants, chelants, and combinations of said stabilizing additives.

23. Di-benzoyl peroxide-containing composite particulates especially suitable for incorporation into granular automatic dishwashing detergent compositions, which composite particulates comprise:

A) from about 10% to 35% by weight of particles comprising water-insoluble di-benzoyl peroxide wherein said particles have a mean particulate size of less than about 200 microns in a wash solution B) from about 50% to 90% by weight of carrier material which comprises polyethylene glycol having a molecular weight of about 8,000 and C) no more than about 3% by weight of free water said composite particulates having a mean particulate size of from about 600 to 1,400 microns.

24. A granular detergent composition especially suitable for use in automatic dishwashing machines, which composition comprises by weight:

A) from about 1% to 15% of diacyl peroxide-containing composite particulates prepared by a process according to claim 1

B) a bleach component comprising either (i) from about 0.01% to 8% as available oxygen of peroxygen bleach or (ii) from about 0.01% to 8% as available chlorine of chlorine bleach C) from about 0.01% to 50% of a pH adjusting component consisting of a water-soluble salt or salt builder mixture selected from sodium carbonate, sodium sesquicarbonate, sodium citrate, citric acid, sodium bicarbonate, sodium hydroxide, and mixtures thereof D) from about 3% to 10% silicate as $SiO_2$ E) from 0% to about 10% of a low-foaming nonionic surfactant F) from 0% to about 10% of a suds suppressor G) from 0.01% to about 5% of an active detersive enzyme and H) from 0% to about 25% of a dispersant polymer wherein said composition provides a wash solution pH from about 9.5 to about 11.5.

* * * * *